US007975500B2

(12) United States Patent
Colnaghi et al.

(10) Patent No.: US 7,975,500 B2
(45) Date of Patent: Jul. 12, 2011

(54) REFRIGERANT ACCUMULATION AND OIL RECOVERY DEVICE FOR REFRIGERANT FLUID RECOVERY/REGENERATION/RECHARGING SYSTEMS

(75) Inventors: Dario Colnaghi, Milan (IT); Stefano Avoledo, Milan (IT); Osvaldo Mascarello, Milan (IT); Jean-Charles Borsatti, Vessy (CH)

(73) Assignee: Parker-Hannifin Corporation, Cleveland, OH (US)

( * ) Notice: Subject to any disclaimer, the term of this patent is extended or adjusted under 35 U.S.C. 154(b) by 442 days.

(21) Appl. No.: 12/142,187

(22) Filed: Jun. 19, 2008

(65) Prior Publication Data

US 2009/0107164 A1 Apr. 30, 2009

(30) Foreign Application Priority Data

Oct. 31, 2007 (IT) ..... MI2007A2100

(51) Int. Cl.
*F25B 45/00* (2006.01)

(52) U.S. Cl. ..... 62/292; 62/470

(58) Field of Classification Search ..... 62/292, 62/77, 85, 149, 470, 474, 512, 513
See application file for complete search history.

(56) References Cited

U.S. PATENT DOCUMENTS

| | | | | |
|---|---|---|---|---|
| 4,805,416 | A * | 2/1989 | Manz et al. | 62/292 |
| 4,942,741 | A | 7/1990 | Hancock et al. | |
| 5,218,834 | A * | 6/1993 | Major et al. | 62/129 |
| 5,247,804 | A * | 9/1993 | Paige et al. | 62/77 |
| 5,361,594 | A * | 11/1994 | Young | 62/129 |
| 5,511,387 | A * | 4/1996 | Tinsler | 62/292 |
| 5,582,019 | A * | 12/1996 | Hanna et al. | 62/85 |
| 5,761,924 | A * | 6/1998 | Peckjian | 62/292 |
| 5,996,372 | A * | 12/1999 | Koda et al. | 62/503 |
| 6,826,925 | B2 | 12/2004 | Renders | |

FOREIGN PATENT DOCUMENTS

| | | |
|---|---|---|
| EP | 1367343 A1 | 3/2003 |
| WO | 9119140 | 12/1991 |

* cited by examiner

*Primary Examiner* — Mohammad Ali
(74) *Attorney, Agent, or Firm* — Daniel J. Whitman; Robert Clark

(57) ABSTRACT

A refrigerant accumulation and oil recovery device for recovery/regeneration/recharging units for a refrigerant fluid withdrawn from refrigeration or air conditioning plants or heat pumps, characterized by comprising a refrigerant fluid accumulation/evaporation vessel and an oil recovery vessel, said vessels being closed at their top by at least one plate which supports them both, the plate presenting a plurality of passages defining, with said vessels, a part of the charging/recycling circuit of said recovery/regeneration unit, in which said accumulation/evaporation vessel and said oil recovery vessel present at least one wall in common, such that any refrigerant fluid leakage from one of said vessels at the connection interface between said common wall and said plate is recovered into the other.

8 Claims, 2 Drawing Sheets

REFRIGERANT ACCUMULATION AND OIL RECOVERY DEVICE FOR REFRIGERANT FLUID RECOVERY/REGENERATION/RECHARGING SYSTEMS

CROSS REFERENCE TO RELATED APPLICATIONS

The present application claims the benefit of the filing date of Italian Patent Application No. MI 2007A002100 filed on Oct. 31, 2007, the disclosure of which is incorporated herein by reference.

BACKGROUND

The present invention relates to a refrigerant accumulation and oil recovery device for refrigerant fluid recovery/regeneration systems.

SUMMARY OF THE INVENTION

It relates in particular to a recovery/regeneration/recharging system for a refrigerant fluid withdrawn from refrigeration or air conditioning plants or heat pumps. The fluids currently used in refrigeration plants or heat pumps are known to be extremely costly. In addition, the gases present in old installations are often damaging to the environment.

There is hence a requirement to recover these gases when work has to be done on existing plants.

It is also sometimes necessary to "clean" and dehumidify the fluid present in such plants, such as when topping them up. In this respect, this fluid is often contaminated by various impurities (such as sludge and metal particles) and by moisture due to prolonged system operation, or deriving from the topping-up operations themselves; These impurities compromise the fluid efficiency and can lead to plant malfunction.

A requirement has therefore arisen for units able to recover, accumulate and regenerate the refrigerant fluid present in known refrigeration or air conditioning plants or heat pumps. Known units present a refrigerant fluid accumulation/evaporation vessel connected by fluid circuits to an oil recovery vessel, in which a filter is provided to separate the oil from the refrigerant. A dehydration filter is also present to retain any moisture accumulated by the refrigerant fluid, a compressor to circulate the fluid during the recycling step, a vacuum pump to prepare the unit its use, an outlet for bleeding off the used oil, a make-up oil inflow connection and an inlet connection for topping-up with fresh refrigerant. The unit also comprises a pair of high/low pressure connections to the plant from which the fluid is withdrawn.

These units usually present a device which groups together the refrigerant fluid accumulation/evaporation vessel and the oil recovery vessel. This device is formed from two open-ended vessels in the form of cylindrical tubular shells sandwiched between two plates interconnected by tie rods. At the interface between the tubular shells and the plates, seats are provided housing four seal gaskets compressed by the tube ends. Conduits and holes are provided in the plates (both lower and upper) to form, together with the vessels, part of the fluid circuit of the unit.

A drawback of the known art is the fact that four junction points are present between the plates and tubes to form the vessels. This creates difficulties in forming time-reliable seals, especially in the presence of widely differing fluids of high corrosive power such as refrigerant fluids.

A further drawback of the known art is that following any leakage due to a compromised or poorly installed gasket, the refrigerant fluid is dispersed into the surrounding environment, with considerable economical and environmental damage.

Another technique of the known art is to assemble the two vessels, normally made of welded and painted iron, directly below the support plate by screwing them together using a threaded collar.

An object of the present invention is therefore to provide a device with a longer life and greater reliability than traditional devices. Another object of the invention is to provide a device which drastically reduces the possibility for refrigerant fluid leakage and which, if any leakage occurs, minimizes the possible dispersion of refrigerant fluid into the environment.

These and other objects are attained by providing a refrigerant accumulation and oil recovery device for recovery/regeneration/recharging units for a refrigerant fluid withdrawn from refrigeration plants, in accordance with the technical teachings of the accompanying claims.

BRIEF DESCRIPTION OF THE DRAWINGS

Further characteristics and advantages of the invention will be apparent from the description of a preferred but non-exclusive embodiment of the device, illustrated by way of non-limiting example in the accompanying drawings, in which.

DESCRIPTION OF THE INVENTION

Figure 1:
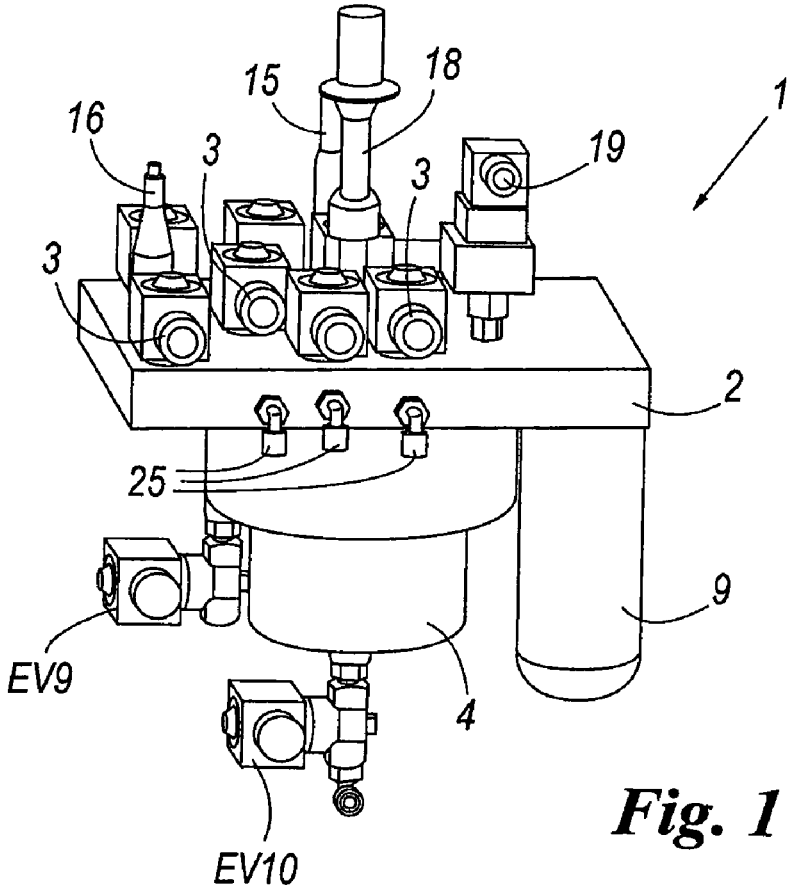
FIG. 1 is a perspective view of a device according to the present invention.
Figure 2:
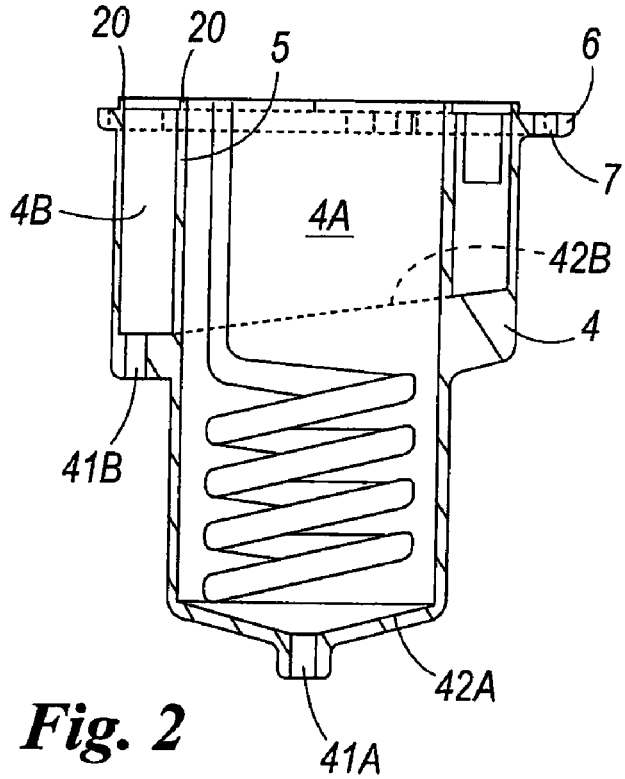
FIG. 2 is a section through a detail of the device of FIG. 1.
Figure 3:
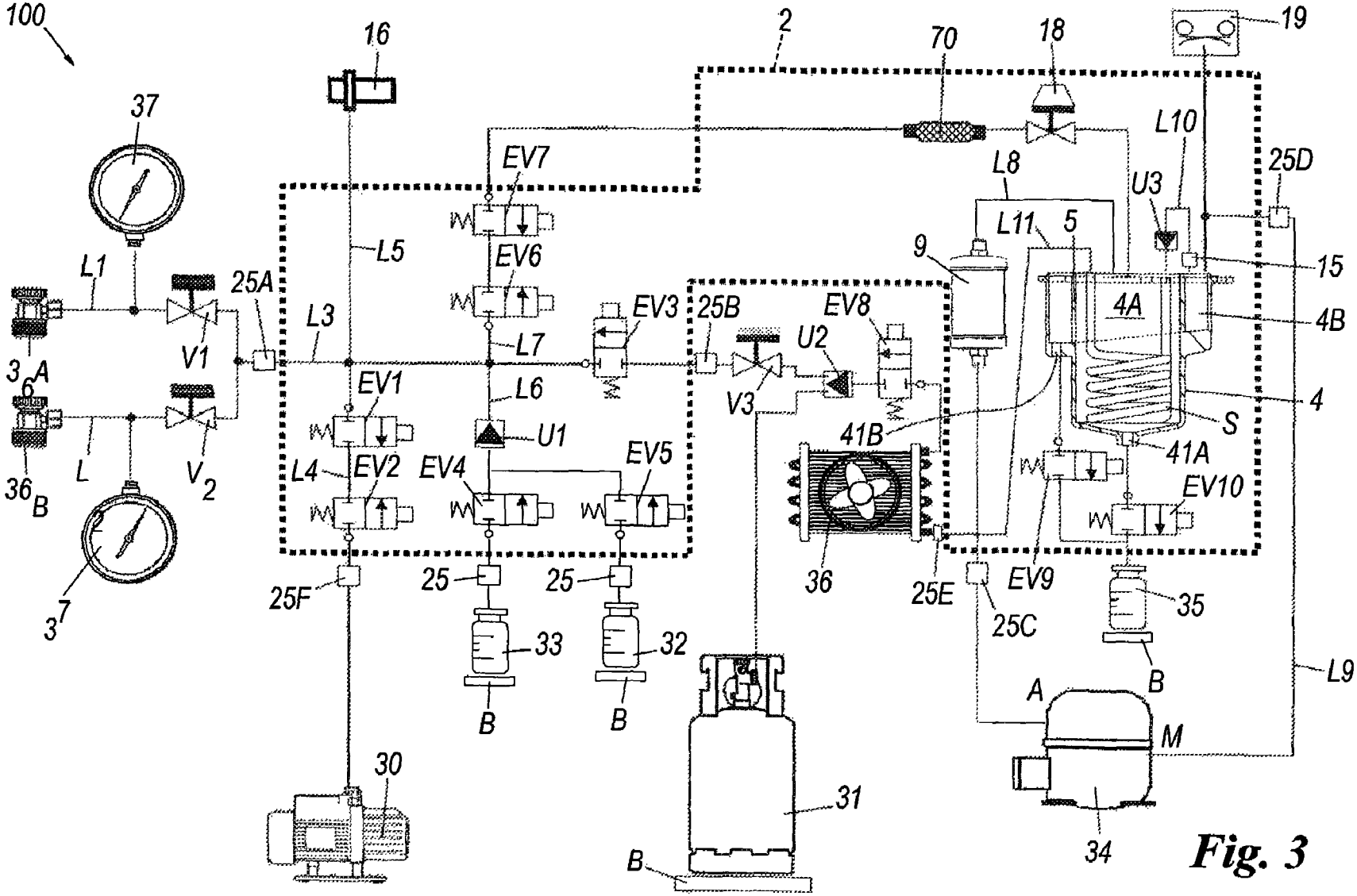
FIG. 3 is a simplified schematic view of a recovery/regeneration unit in which the device of FIG. 1 is present, connected to a plurality of auxiliary devices of the unit.

With reference to said figures, these show a refrigerant accumulation and oil recovery device indicated overall by the reference 1. This device forms part of a recovery/regeneration unit; an example of a regeneration unit is shown in FIG. 3. The device 1 comprises a plate 2 in which a plurality of fluid passages are provided. These passages are intercepted by suitable solenoid valves 3 which enable the refrigerant fluid flow through said passages to be deviated and controlled. A mechanical filter 15 (coalescent), a transducer 16, a constant pressure maintaining valve 18 and a pressure switch 19 are present above the plate 2 and suitably connected to said passages. A preferably metal alloy die-cast body 4 having the cross-section shown in FIG. 2 is fixed to the underside of the plate 2. It can be made of any material such as aluminium, steel or possibly reinforced plastic, for example by hot forging in the case of metals or by injection moulding in the case of plastic. This body 4 defines a first vessel 4A (or inner vessel) used as a refrigerant fluid accumulation/evaporation vessel and a second vessel 4B or outer vessel, formed as a ring about the upper part of the first vessel 4A and used as an oil recovery vessel. The vessels 4A and 4B are cylindrical of respectively circular and annular cross-section, but can assume any shape. The wall 5 of the body 4 is hence common to both the first vessel 4A and the second vessel 4B, and substantially separates them. At the top (FIG. 2) of the body 4 a flange 6 is provided comprising a plurality of holes 7 for fixing the body to the plate by suitable screws. Annular rims 20, formed as a prolongation of the vessel walls, project slightly from said flange 6. In use, these annular rims 20 are housed in suitable seats (not shown) provided on the plate 2, and in which seal gaskets (also not shown) are housed. Each of the vessels presents, on its base, an inclined surface 42A, 42B to guide their contained fluid towards a hole 41A, 41B.

In the internal first container 4A this inclined surface is defined by a funnel region 42A which converges towards the hole 41A. This hole is intercepted by a solenoid valve EV10 openable under the control of the user.

In the second container 4B the surface 42B is inclined towards the hole 41B and is of annular shape. The hole 41B is intercepted by a solenoid valve EV9. The plate 2 also lowerly presents a threaded hole (not shown) into which a dehydration filter 9 is screwed to retain any moisture contained in the refrigerant.

The said passages provided in the plate 2, the vessels 4A, 4B and the dehydration filter 9 all form part of the charging/recharging circuit of said recovery/regeneration unit.

To conclude the description, it should be emphasized that the plate provides a plurality of connectors 25 enabling the passages formed therein to be connected to auxiliary devices such as: a vacuum pump 30, a reserve of refrigerant fluid 31, a new oil container 32, a UV leakage testing liquid container 33, a compressor 34, a waste oil container 35, a condenser 36, and a pair of high and low pressure quick couplings 36A, 36B provided with pressure gauges and cocks for connecting the device to an air conditioning plant, refrigeration plant or heat pump. The recovery/regeneration unit 100 shown in FIG. 3 is formed by connecting the device 1 to said auxiliary devices. The unit described herein is provided by way of example only. In this respect, the auxiliary devices, the passage configuration in the plate, and the number and arrangement of the solenoid valves can be varied.

The unit of FIG. 3 is described hereunder in detail. The quick couplings 36A and 36B are connected by lines L1 and L2 to a connector 25A provided on a line L3; at the opposite end of this line there is provided a further connector 25B close to which a solenoid valve EV3 is present. The lines L1 and L2 are provided respectively with a pressure gauge 37 and a manual shutoff valve V1, V2. The line L3 communicates with the lines L4, L5, L6 and L7. The vacuum pump 30 is connected to the line L4 by a connector 25F; a pair of solenoid valves EV1 and EV2 are also present in this line. The line L5 is associated with a pressure transducer 16. The line L6 presents a unidirectional valve to which the new oil container 32 and leakage testing liquid container 33 are connected via two solenoid valves EV4 and EV5. The line L7 opens into the first vessel 4A and comprises in sequence two solenoid valves EV6, EV7, an antivibration tube 70 and a pressure regulator 18.

A line L8 emerges from the vessel 4A directed to the suction side of the compressor 34; the dehydration filter 9 and a connector 25C are present in this line. The delivery side of the compressor 34 is connected by the line L9 to the second vessel 4B; a connector 25D and a pressure switch 19 are provided in this line. From the second vessel 4B a line L10 emerges to open via a non-return valve U3 into a coil S housed in the first vessel 4A. Provided in the line L10 there is a coalescent-type mechanical filter 15 which when in use is completely housed in the interior of the vessel 4B.

The line L11 emerges from the coil and connects it to a connector 25E. The condenser 36 is connected to the connector 25E and communicates via a solenoid valve EV8 with a three-way unidirectional valve U2. The unidirectional valve U2 is also connected via a manual valve V3 to the connector 25B (and consequently to the line L3) and to a refrigerant fluid reserve 31.

The hole 41B in the second vessel 4B and the hole 41A in the first vessel are connected via the solenoid valves EV9 and EV10 respectively to waste oil container 35. The containers 32, 33, 35 and the reserve 31 are positioned on electronic balances B. FIG. 3 schematically shows the plate 2 by a dashed outline. The described lines L3-L11, which are internal to the dashed outline, are defined by the plate passages, the solenoid valves EV1-EV7 being mounted on the plate 2.

The unit operates in the following manner.

The vacuum pump 30 is firstly operated (vacuum step) to put all the unit components under vacuum. During this step the valves V1 and V2 are open, the quick couplings have their cocks closed, the solenoid valves EV4 and EV5, EV9 and EV10 are closed, and the solenoid valves EV8, EV3, EV6, EV7, EV1 and EV2 are open. The reserve 31 is closed.

When vacuum has been achieved, verified by the pressure gauges 37, the solenoid valves EV1 and EV2, EV8 and EV3 are closed. The quick couplings 36A, 36B are connected to a high and low pressure take-off of a plant on which maintenance is to be carried out, and their cocks are opened. The compressor 34 is started in order to draw the refrigerant fluid into the recovery/regeneration unit through the lines L3-L7. The refrigerant is accumulated in the first vessel 4A and in the rest of the plant. When all the refrigerant has been drawn in, the valves V1 and V2 are closed. Maintenance can hence be carried out on the refrigeration plant, air conditioning plant or heat pump connected to the unit.

The unit also enables the refrigerant present in the unit to be regenerated. In this step, the solenoid valves EV8 and EV3 are opened. The refrigerant fluid (vapour) present in the vessel 4A is redrawn by the compressor 34 through the dehydration filter 9 and compressed, then fed through the line L9 to the second vessel 4B. The refrigerant vapour leaves the second vessel 4B through the line L10 in which the coalescent filter 15 separates oil from the refrigerant vapour. The oil accumulates on the external surface of the filter and falls into the second vessel 4B, to accumulate in it.

The hot vapour passes from the line L10 through the coil S where it exchanges heat with the liquid contained in the first vessel 4A; this liquid is hence evaporated. On leaving the coil the hot vapour is conveyed by the line L11 into the condenser 36 where it transfers heat to the outer environment and condenses. The liquid thus formed passes to the line L3 from which it flows through the line L7 to return to the first vessel 4A where it evaporates, to again initiate the initially described cycle.

The fluid is hence recycled many times, filtered from the oil and dehydrated. In addition, the impurities present therein are collected on the base of the first vessel 4A, where the sludge and impurities carried by the refrigerant (which is also typically a detergent) are deposited. They are then expelled through the base solenoid valve EV10. The oil however is separated by the coalescent filter and accumulates in the external container, of small volume, from which it can be recovered or evacuated via the base solenoid valve EV9. In the scheme of FIG. 3 it is conveyed into the waste container 35.

On termination of the fluid regeneration step, the oil level can be restored using oil from the container 32 and UV leakage testing liquid added from the container 33 by suitably acting on the valves and solenoid valves. Any required refrigerant fluid can be added from the reserve 31. These operations and the manner of controlling the valves to achieve them are evident to an expert of the art and will not be described in detail. The operation of the solenoid valves, the compressor and the vacuum pump can be controlled by electronic modules or cards. Hence the manner in which the operations are to be carried out (vacuum, regeneration, recharge, leakage testing addition, etc) can be selected to achieve automatic opening and closure of the solenoid valves and automatic operation of the pump or compressor, in such a manner as to obtain the chosen operational step. Oil and refrigerant charging can also be effected on the basis of data measured by the electronic balances B.

It should be noted that the unit described in FIG. 3 is only one example of how a device 1 such as that described can be used. Its internal circuitry defined by the passages in the support plate can also be of any type and configuration suitable to enable the invention to function. Hence a smaller or greater number of valves can be provided depending on the circuit to be obtained and the functions which the machine is to implement.

The described embodiment of the device has many advantages. In this respect, any leakage which may take place at the interface between the wall 5 and the plate 2 would not lead to dispersal of refrigerant fluid from the second vessel 4B towards the outside, but simply its seepage into the first vessel 4A. This is because the pressure therein is less than the pressure in the second vessel 4B. Neither is any refrigerant leakage from the first vessel 4A to the second 4B possible, as this latter is under greater pressure during use.

Compared with the known art, only two gaskets are present instead of the four present on the vessels of traditional solutions.

Moreover compared with solutions comprising two plates, the described solution results in a reduction in connections, as it is no longer necessary to connect the lower plate to the upper plate; all the connections and passages are provided on the single plate.

The presence of a single body 4 to be fixed to the plate results in easier assembly and reduces the possibility of assembly error which could compromise the gasket seal and reliability.

Many alternative embodiments of the device are possible. For example, the plate passages can be designed such as to use the first vessel 4A as the oil container and the second vessel 4B as the accumulator/evaporator. In that case the coil would be provided in the second vessel and other plant modifications would be required, but all evident to the expert of the art. The advantages described for the preceding embodiment are also present in this latter embodiment.

In a different embodiment the first and second vessel can have any configuration, provided they have at least one wall in common. They can be provided for example in a single lowerly closed cylindrical container divided by a baffle dividing the two vessels.

What is claimed is:

1. A refrigerant accumulation and oil recovery device for recovery/regeneration/recharging units for a refrigerant fluid withdrawn from refrigeration or air conditioning plants or heat pumps, comprising a refrigerant fluid accumulation/evaporation vessel and an oil recovery vessel, said vessels being closed at their top by at least one plate which supports them both, the plate presenting a plurality of passages defining, with said vessels, a part of the charging/recycling circuit of said recovery/regeneration unit wherein the accumulation/evaporation vessel and the oil recovery vessel present at least one wall in common, such that any refrigerant fluid leakage from one of said vessels at the connection interface between said common wall and said plate is recovered into the other, an outer vessel between said accumulation/evaporation vessel and said oil recovery vessel completely surrounds the inner vessel, at least at said common wall, wherein the vessels are of cylindrical shape, the outer vessel having a lesser height than the inner vessel.

2. A device as claimed in claim 1, wherein the accumulation/evaporation vessel and said oil recovery vessel are formed in a single body.

3. A device as claimed in claim 1, wherein the outer vessel has a smaller volume than the inner vessel.

4. A device as claimed in claim 1, further comprising a coil in the accumulation/evaporation vessel to raise the temperature of the refrigerant fluid accumulated therein.

5. A device as claimed in claim 1, wherein each of said vessels presents on its base an inclined surface to convey their contents towards a hole which is connected to a valve means openable in a controlled manner.

6. A device as claimed in claim 1, wherein the body is produced by die-casting.

7. A device as claimed in claim 1, further comprising a dehydration filter connected to said plate, said filter forming part of the charging/recirculation circuit of said recovery/regeneration unit.

8. A device as claimed in claim 1, wherein the outer vessel is for oil recovery, whereas said inner vessel is for accumulation/evaporation.

* * * * *